United States Patent [19]

Mayer

[11] 3,987,974

[45] Oct. 26, 1976

[54] MOVABLE BOBBIN TRANSPORT APPARATUS

[75] Inventor: Manfred Mayer, Remscheid-Lennep, Germany

[73] Assignee: Barmag Barmer Maschinenfabrik Aktiengesellschaft, Wuppertal, Germany

[22] Filed: June 12, 1974

[21] Appl. No.: 478,531

Related U.S. Application Data

[62] Division of Ser. No. 252,309, May 10, 1972, Pat. No. 3,895,725.

[30] Foreign Application Priority Data

May 13, 1971 Germany ..... 2123689

[52] U.S. Cl. ..... 242/35.5 A

[51] Int. Cl.[2] ..... B65H 54/20; B65H 67/04

[58] Field of Search ..... 242/35.5 A, 35.5 R, 242/35.6 R, 41

[56] References Cited

UNITED STATES PATENTS

| | | | |
|---|---|---|---|
| 3,092,340 | 6/1963 | Furst | 242/35.5 R |
| 3,099,410 | 7/1963 | Chambley | 242/35.5 R |
| 3,160,359 | 12/1964 | Furst | 242/35.5 R |

FOREIGN PATENTS OR APPLICATIONS

| | | | |
|---|---|---|---|
| 1,955,352 | 5/1971 | Germany | 242/35.5 R |

*Primary Examiner*—Stanley N. Gilreath
*Attorney, Agent, or Firm*—Johnston, Keil, Thompson & Shurtleff

[57] ABSTRACT

Bobbin transport apparatus movable along a textile machine front in a prescribed path for the conveyance of bobbins to be fed in and finished bobbins to be removed by means of an automatic bobbin changer in multi-station, multilevel textile machines.

14 Claims, 11 Drawing Figures

FIG. 2
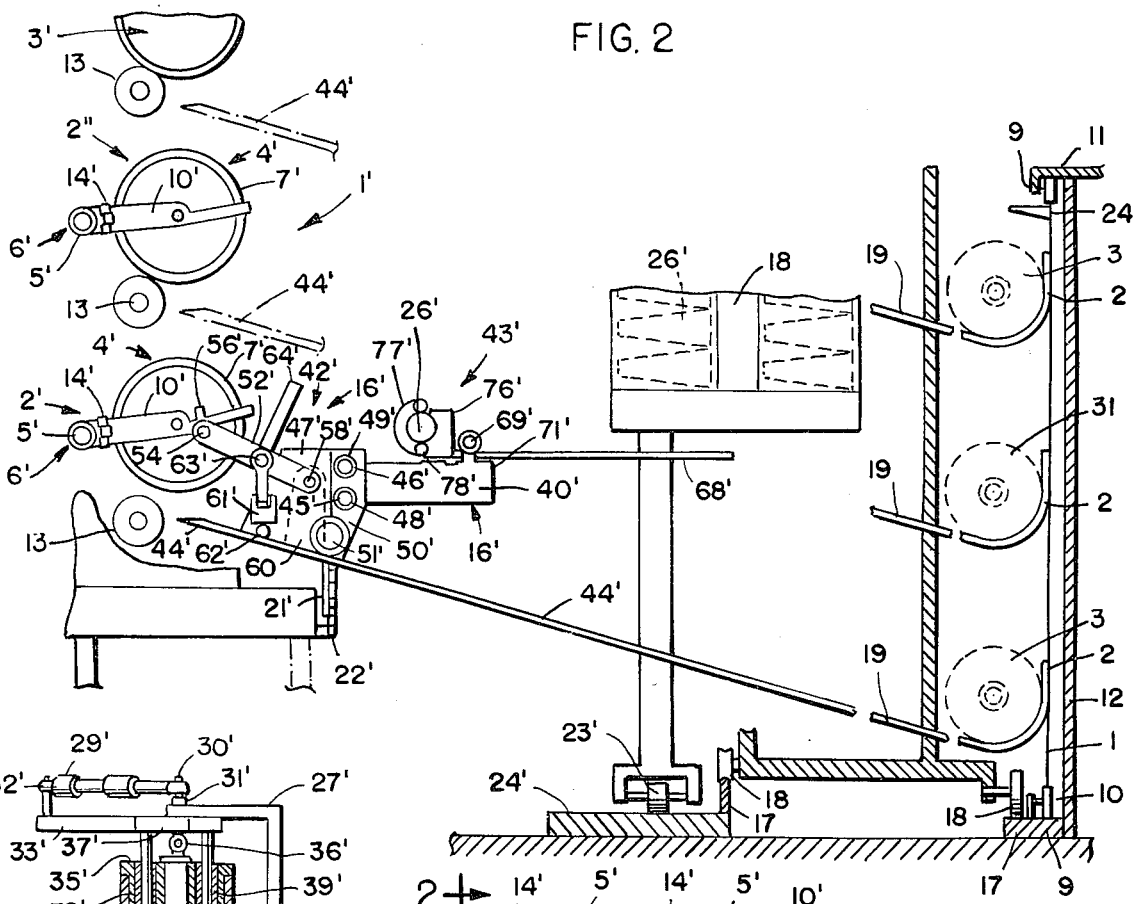
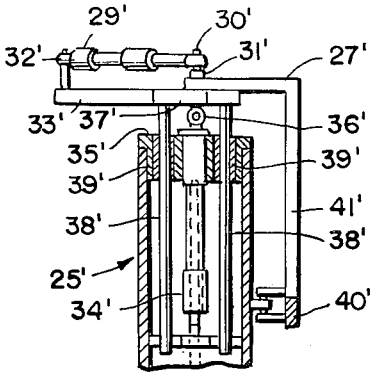
FIG. 4A
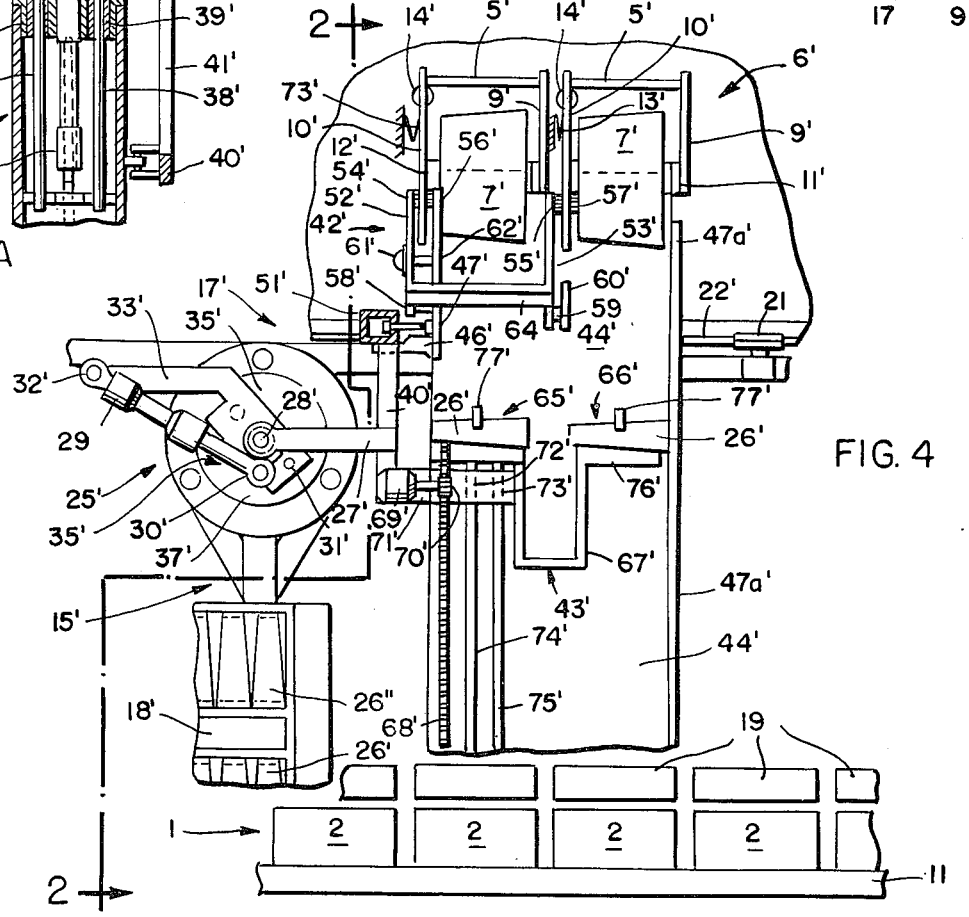
FIG. 4

MOVABLE BOBBIN TRANSPORT APPARATUS

RELATED APPLICATION

This application is a division of my copending application Ser. No. 252,309, filed May 10, 1972, now U.S. Pat. No. 3,895,725, issued July 22, 1975.

Textile machines, such as, for example, spinning machines, stretching machines, twisting or texturizing machines have large number, for example, 120 or more, individual treatment stations. The treatment stations are arranged not only on both sides of the machine but also in decks, one above another. The bobbin change can take place by means of an automatic bobbin changer in several stations simultaneously, and the stay or residence time for changeovers per station can be correspondingly shortened. The individual treatment stations are driven in normal operation at identical operation conditions. Especially in the treatment of polymer threads, it is necessary to attune the individual operating parameters, such as, for example, thread speed, thread tension, temperatures, heating arrangements optionally present, twisting, false twisting, etc., to one another exactly, in order to obtain an optimal product. In addition, for the treatment of polymer threads, the individual operating parameters must be maintained within narrow tolerances. Thereby each treatment station is extremely subject to breakdown and requires a continuous or regular, periodic monitoring of its proper functioning. This function monitoring can be managed, for one thing, by special technical arrangements, especially measuring and regulating systems. To an increasing degree, also, quality testing is used for the assurance and improvement of the quality of future production as well as for the qualitative classification of the finished products. The ascertained quality of an end product or intermediate product provides a basis for judgment of the functioning of the treatment places in the production path.

With this goal of quality check, which can take place preferably also according to statistic processes, it is absolutely important that each product be followed as exactly as possible on the way through the textile plant from the input check of the raw material or intermediate product to the finished bobbin, and the results established in the quality control (for example, thread strength, stretch, winding tension, breaking tension, twist, curl contraction, etc.) can at any time be clearly allocated to the working positions concerned in each case and to the pre-products fed to these, i.e., feed bobbin windings. Insofar as the textile machines are operated by hand, this allocation is accomplished by numbering each individual treatment station, and each (or only each to be checked) of the slipped-on feed bobbins or removed finished bobbins is correspondingly marked.

This procedure runs into difficulties with the hand operation of the textile machine, since it brings about time losses and can lead to faulty identifications. It is not applicable at all when the bobbin change and, in particular, the removel of the finished bobbins, is automated.

Bobbin transport devices for the conveyance to and away for textile machines operated by means of automatic bobbin changers have become known in many various forms. In these known devices, however, it was not possible to pursue either the origin of the feed bobbin fed to the textile machine, or in other zones of the textile mechanism, as, for example in the further processing and/or in the quality control, to determine in which treatment station of the textile machine a finished bobbin was processed. In Published German Patent Application No. 1,510,620, a device for the fully automatic removal of full tubes on continuous spinning and twisting machines lets the drawn-off cops or windings slide over a chute onto a conveyor belt. It permits no allocation of the cops to their treatment places, since in the case of non-discharge of a cop, the corresponding place on the conveyor belt and in the storer is occupied by the cop coming from the next place. Moreover, the problem of allocation of the finished bobbins to their treatment places arises not only in the bringing of the bobbins onto the conveyor belt, but to an increased degree, also in the removal from the conveyor belt. Here the finished bobbins —as, for example, U.S. Pat. No. 3,534,539 teaches —are to be conveyed into a transport means (for example, a movable container), where they are deposited in disorder. In another conveying arrangement, U.S. Pat. No. 3,070,949, the finished bobbins are taken off by an automatic bobbin changer, in which system the bobbin changer deposits the bobbins directly in a container that is carried along. Here, too, it is not possible to determine in which treatment place a bobbin lying in the conveyance container has been processed. Known systems for the supplying of feed bobbins, which have become known, for example, through U.S. Pat. No. 3,534,539 and German Pat. No. 1,929,961, fail to meet the requirement that the path of the feed bobbin should be and remain possible to follow, since these systems are charged with bobbins deposited in a random manner in transport containers.

It is the objective of the invention to overcome the disadvantages of the known bobbin transport devices and to create bobbin transport devices of the type presented at the outset, in which the allocation of the finished bobbins to their treatment stations, and preferably also to their pre-product and its treatment stations, remains preserved in a clear manner after the removal of the bobbins from their spindles or winding devices, their conveyance from the machine, in the further processing and in the quality control, sorting and/or other handling.

For this purpose it is proposed that the transport device have arrangements for the reception of the bobbins, which are geometrically allocated to one another in the same manner as the bobbin locations of the textile machine. The arrangement of the devices for the reception of the bobbins can be congruent or similar to the arrangement of the winding heads on the textile machine. Differing dimensions and also slightly differing arrangements do not play any role, as long as to each winding head there is clearly and unambiguously allocated a bobbin receiving unit. For the clear stressing of this allocation it can, in particular, be expedient also to arrange the receiving devices in zones which correspond to the zones of the winding heads. This arrangment and disposition of the bobbins traversed by the transport device of the invention makes it possible, by means of automatic bobbin changers, to feed to each treatment station of the textile machine a feed bobbin of a certain charge, qualification, origin, property, etc. and still to determine the origin of the finished bobbin even after removal and conveyance away from the textile machine.

In one form, the bobbin transport device is a vertical lattice which extends preferably over the entire length of the machine.

The process of the depositing of bobbins on the transport device can be carried out by hand. The device is movable along the floor and can be provided with wheels swingable in all directions.

An especially advantageous form which makes it possible to displace the bobbin transport device in prescribed paths and automatically, consists in a device which is displaceable on or in rails. These rails can be arranged for standing or suspended transport of the bobbin transport device which can be shifted in common manually with a chain, a rope or similar endless band continuous running drive means, to which the bobbin transport device is connected. According to another form of the invention, the device is characterized by a power drive for moving the device. The advantage of this form lies in that constantly running drive means, which can be spatially troublesome and which in running unconnected, waste energy requirement and induce wear, are rendered unnecessary. Advantageously this bobbin transport device is equipped in such a way that it is arranged for suspended transport in the rails provided for a blowing or suction installation. There is yielded the further problem of forming the bobbin transport device in such a way that it is movable with small expenditure of space, in particular so that it can be driven through relatively close turns and in relatively close space. For this, the bobbin transport device consists of several members in series in the longitudinal direction. These members can be connected with one another by means of releasable couplings. The individual members can correspond according to their length and according to the number of bobbins deposited on them, each to a zone of processing stations.

The devision of the bobbin transport device into a series of members permits a very advantageous transport device. In this form, the bobbin transport device is characterized by a transport container which is displaceable perpendicularly to the longitudinal axis of the machine and is positionable in front of the head of the textile machine. It has guide and receiving arrangements into which the individual members of the bobbin transport device are slidable in a defined sequence, preferably in the sequence of the treatment stations. In the loading of such a transport container, it, after loading of one member, is driven onward by approximately one width of the bobbin transport device, and thereupon the next member is ready for loading.

In order to make unnecessary a manual operation of the couplings between the individual members of the bobbin transport device, various forms for couplings are proposed. Preferred couplings are those which can absorb only such forces as run substantially in the longitudinal axis of the bobbin transport device and which can be uncoupled by movement of the members transversely to the longitudinal axis of the bobbin transport device.

In this preferred embodiment of the invention, there is the further problem of automating the introduction of the bobbin transport device into the transport container. For this it is proposed that the transport container have a drive for the stepwise displacement as well as switching devices which are arranged in the zone of the guide and receiving arrangements and are operated by entry of each individual member into the transport container. Further, there is proposed a stationary drive mounted in the zone of the textile machine for the further transport of the bobbin transport device, in which system this drive can be a friction drive. Finally, for the purpose of automating the introduction process, there is proposed a switching device interacting with the transport container, over which the drive for the further transport of the bobbin transport device can be set in operation by standstill of the transport container and can be set out of operation by movement of the transport container. Such a switching device can consist, for example, of a simple pressure switch which is operated by cams or the like fastened to the transport container and over whose output signal the drive for the further transport of the bobbin transport device is set in operation and out of operation.

Through this combination of measures which are useable also individually and which, each by itself, still leads to a facilitation in the shifting of the bobbin transport system, it becomes possible, in alternating rhythm, to slide in the individual members of the bobbin transport device, with transport container at a standstill, into the latter and, with the bobbin transport device at a standstill, to move the transport container one prescribed step onward automatically.

For the loading of the bobbin transport device there are provided according to the invention automatically operating bobbin changing devices, whose type is optional. Preferably types are used which are characterized in that the automatic bobbin changer is arranged between the textile machine and the bobbin transport device, which is movable in longitudinal direction of the machine. Bobbin changers of this type are known, for example, through German published application P 20 37 826.1. Bobbin changers of this construction offer the advantage that it is not necessary to provide each treatment station with a changing device of its own. Nevertheless a faster changing is possible, and during the changing process there is an operative connection between the particular run-off or take-up place and the depositing device allocated to it. For the local connection between run-off bobbin or take-up place and depositing device, the automatic bobbin changer may have a chute for the conveyance of the bobbins between the textile machine and the bobbin transport device, the chute having the same inclination as the line between the run-off bobbin or winding places and the devices allocated to them for the reception of the bobbins.

In order to avoid the situation that the chute has to be set higher in operation for the individual decks and in order to make possible the simultaneous serving of several decks, the chute is constructed in multilevel form. The bobbin changer and the chute can extend over several adjacently situated treatment zones.

It is expedient that all the bobbins and, in particular, finished bobbins lie on the bobbin transport device in one direction. For this reason, the device has, according to the invention, troughs or partial troughs for the reception of bobbins. Another possibility utilizes protruding hooks for the reception of the finished bobbins.

If the bobbin holders of the winding bobbins are arranged in such a way that the bobbin axis does not lie parallel to the longitudinal axis of the machine, as, for example, in the case of vertically standing spindles, there can be provided in the chute deflecting elements by which the axes of the finished bobbins are aligned essentially parallel to the axes of the troughs or hooks.

The quality control of the finished bobbins deposited and transported on the bobbin transport device of the invention, and the identifying marking of their processing station can—as is conventional—be accomplished by hand at any point of the textile plant and can be associated expediently with a sorting operation or possibly the packing step. In order to do justice to the functions of preventive quality controls—as they have been described above—it is proposed according to the invention that the device be introduced into an automatic quality testing and sorting apparatus, which is provided with sensing and counting mechanisms or similar devices and printing mechanisms, over which the depositing place and the allocated processing stations of the finished bobbins are automatically detected and preferably expressed with the test result or otherwise rendered visible. Thereby it becomes possible to carry out the quality check with economy in labor, time and costs, and simultaneously to obtain data for the appraisal of the functioning of the processing stations. It is necessary for this merely to assign each bobbin transport device of a certain textile machine an identification by a special general identification. If, however, one bobbin transport device is used alternately for several textile machines a special characterization of the textile machines served in each case is necessary on the bobbin transport device. For this, for example, there can be a coding device mounted on the bobbin transport device. On this coding device there is set a signal allocated in each case to the particular textile machine. This can be accomplished by hand or, for example, by means of a signaller mounted on the textile machine, which contains a certain arrangement of switching cams for the switching of the signal allocated to the textile machine.

THE DRAWINGS

In the following the invention is described with the aid of FIGS. 1 to 10, wherein:

FIG. 1 is a perspective view of a bobbin transport device and a bank of winding stations;

FIG. 2 is a side elevation, partly in vertical section as viewed from section line 2—2 of FIG. 4, showing the transport device, the winding stations of textile machine (in part) and the associated automatic bobbin changers disclosed in U.S. Pat. No. 3,811,631;

FIG. 4 is a fragmentary top plan view of the transport device, textile machine and associated automatic bobbin changer illustrated in FIG. 2;

FIG. 4A is a side elevation, partly in diametric, fragmentary sections, of the bobbin changers' pivoting and lifting mechanism;

The bobbin transport device 1 and 1a consists, in FIGS. 1 to 4, of several members or sections 6 and 6a. The individual members are connected with one another by couplings 7 and 7a. The couplings are operated by hand.

Figure 1:
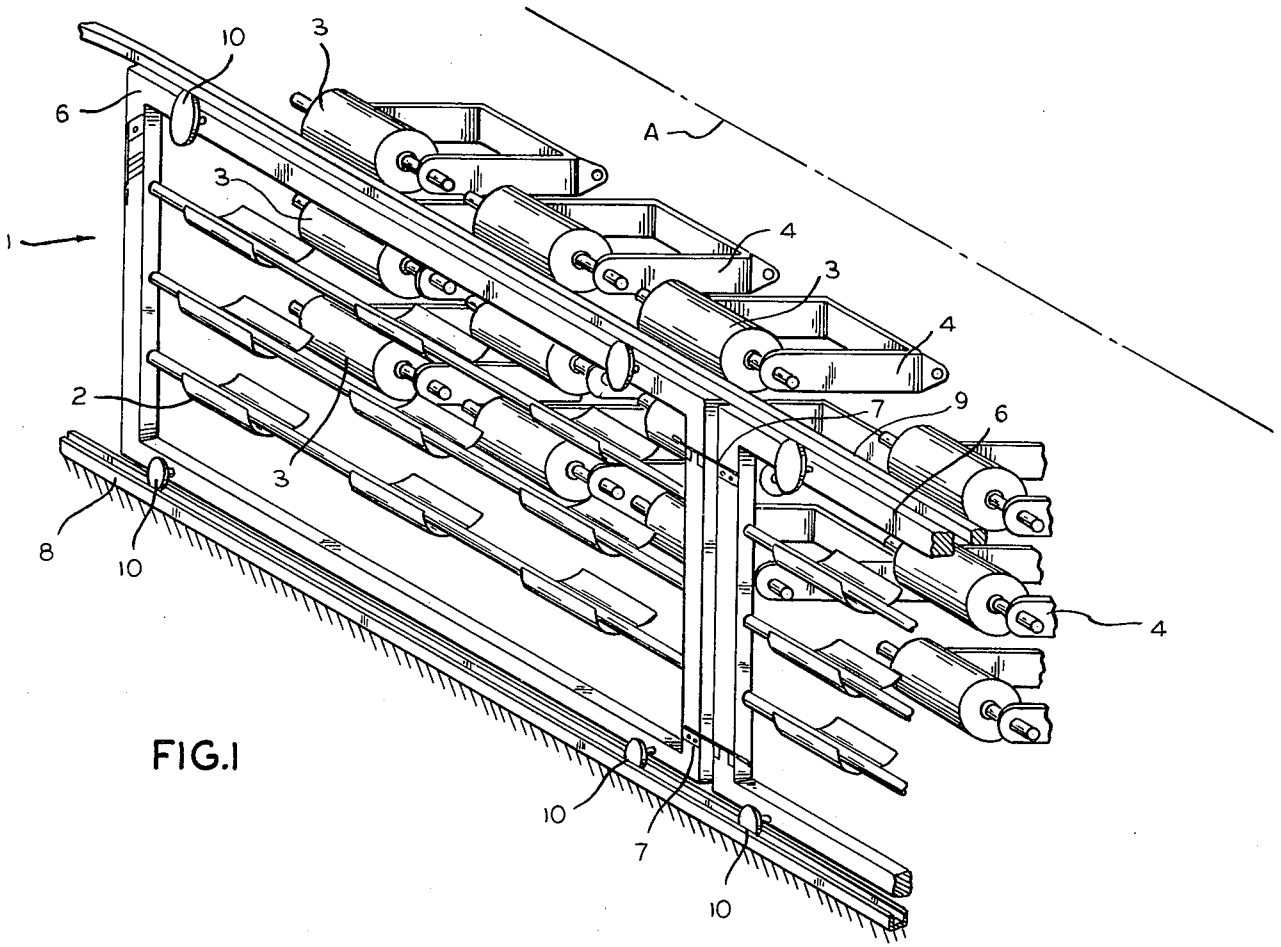
Figure 3:
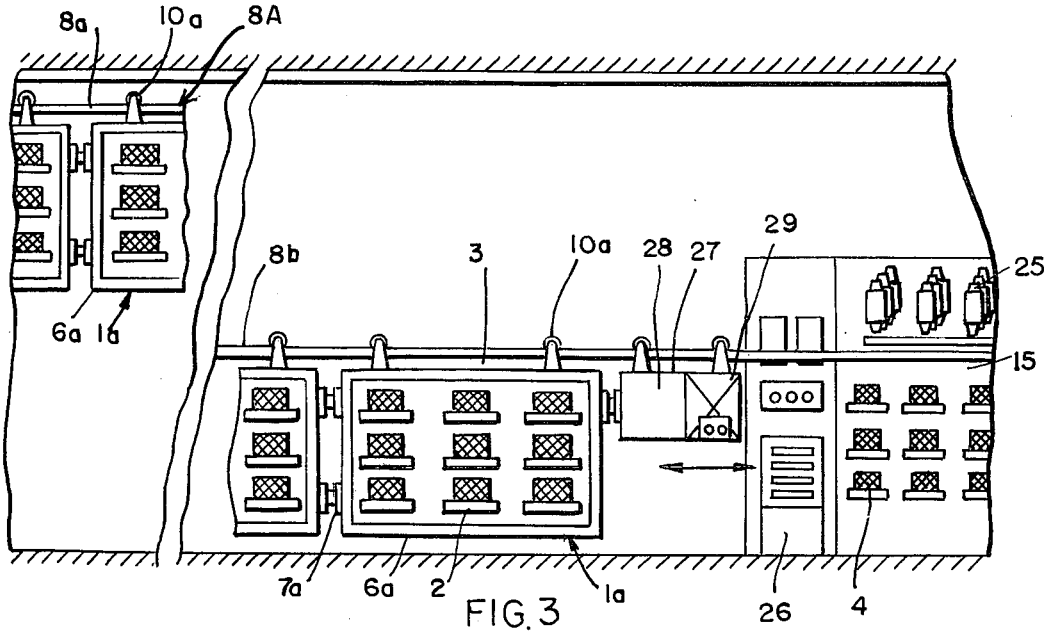
FIG. 3 is a fragmentary, side elevation of an overhead rail-supported transport device and a front elevation of part of a textile machine.
Figure 5:
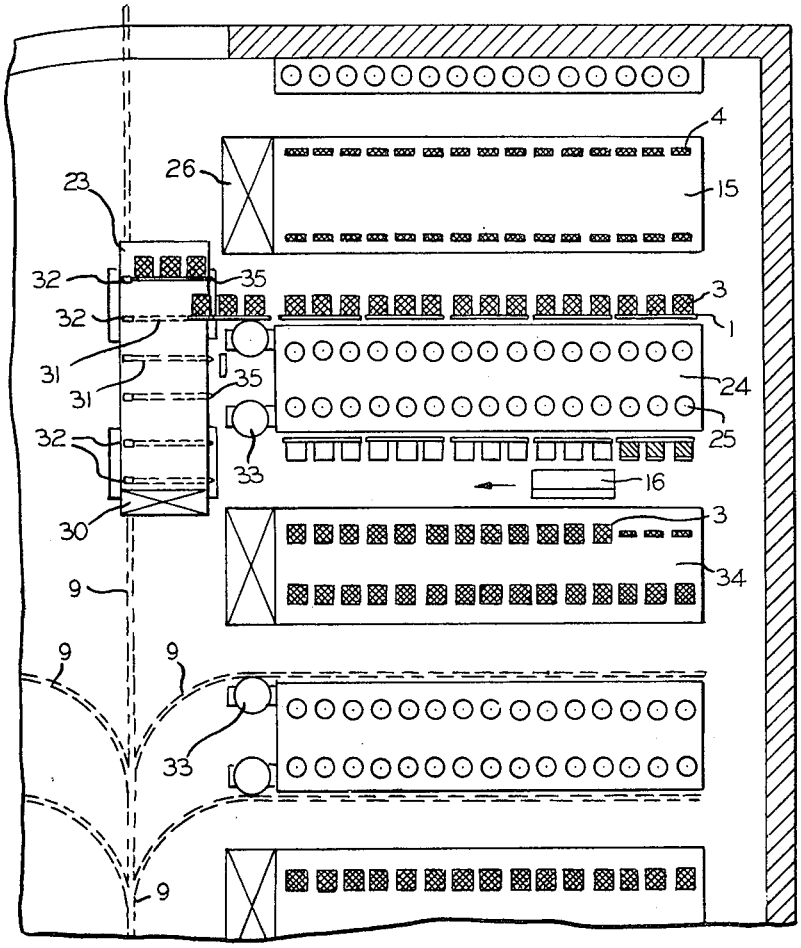
FIG. 5 and FIG. 6 are schematic representations of a bobbin transport system with a bobbin transport device according to the invention.

The bobbin transport device or 1a contains partial troughs 2, into or onto which the finished bobbins 3 are deposited. The winding units 4 respectively are allocated to the troughs 2, which carry finished or nearly finished bobbins 3. The bobbins 3 are driven by drive rollers 81. The textile machine otherwise is represented merely by its longitudinal axis A (FIG. 1) or its segment 15 (FIGS. 2–4). The bobbin transport device, which in the embodiment shown in the drawings according to FIGS. 1, 2 and 4, is a vertical lattice, runs with wheels 10 on rails 8 and 9, which are arranged at some distance from the textile machine on a support frame 11,12 (FIG. 2). In textile machines with separate bobbin lattice for the run-off bobbins, such as is used for example preferably in texturizing machines and is represented in FIG. 5, the rails can be fastened advantageously to the run-off bobbin lattice. Between the textile machine 15 and the bobbin transport device 1 there is arranged an automatic bobbin changer 16 supported on rails 17 by wheels 18 and movable in longitudinal direction of the machine. The automatic bobbin changer can be arranged for the rhythmic operation of one or more vertical rows of winding units, i.e., for the removal of finished bobbins and for the setting on of empty tubes or else for random bobbin change. It brings about— insofar as the removal of the finished bobbins is concerned—via a lever system the lifting off of the finished bobbins from their drive rollers 13 and the lateral removal movement of the bobbin holder. Thereby, the finished bobbins 3 slide onto the individual decks of the chutes 19, 20 and into the receiving devices, i.e., troughs 2. If, by way of exception, a manual operation of individual places of the textile machine should become necessary—for example in the event of thread breakage—the removed bobbins are deposited on or in special bobbin receiving devices, for example, onto a hanger attached to the transport device such as shaft 24 (FIG. 2) or in a container.

As described in U.S. Pat. No. 3,811,631, issued May 21, 1974, the automatic bobbin changer illustrated in FIGS. 2, 4A and 4 and the associated textile machine comprises arrangements 4' in three banks 2', 2'' and 3'. Each winding arrangmeent consists essentially of a bobbin holder 6' which can swivel up and down about a horizontal shaft 5' and serves to accommodate a bobbin 7', and a fixedly arranged driving roller 13, which is continuously driven in a manner now shown.

The bobbin holder comprises two arms 9' and 10' which, with their respective centering plates 11' and 12', engage the ends of the winding tube which is a hollow truncated cone. For cancelling the centering action, one arm 10' can be swung out laterally about a shaft 14' against the force of a spring 13'. The same arm is extended in relation to the other arm 9' to form the so-called bobbin lever, by means of which the bobbin holder is swung upwardly in order to bring the bobbin out of contact with the driving roller 13.

A mechanism automatically feeds the bobbin holders. The feeding unit 15' comprises an underframe 16', on which are arranged a feeding mechanism 17', and an empty tube magazine 18'.

The underframe consists of a frame unit 20', which is guided on the side of the textile machine by means of two spaced grooved wheels (only one, 21', is shown) engaging a guide rail 22' mounted on the textile machine, and is supported approximately centrally on the opposite side, so as to produce a three-point mounting, by means of a wheel 23' on the floor 24'.

The entire feeding mechanism 17' is arranged so that it can pivot about a fixed pivot unit 25' mounted on the underframe 16'. The pivotal range is 90°, this being between the feeding position shown in FIGS. 2 and 4 and a position (not shown) swung out relatively thereto by 90°. Firstly the mechanism 17' is provided with new empty tubes 26' from the magazine 18' and secondly the complete feeding unit 15' is moved along the textile machine.

The pivoting mechanism is to be seen from FIG. 4. A pivot arm 27', on which the feeding mechanism 17' is arranged in a manner to be discussed in greater detail below, is arranged to turn about a shaft 28'. The turning movement is effected by a swivelling cylinder 29', the piston rod end of which is connected at 30' to a projection 31' on the arm 27' and the cylinder end of which is connected at 32' to an arm 33' which is rigidly connected to the pivot unit 25'.

The feeding arrangment 17' is arranged to be adjustable in height on the pivot unit 25'. For this purpose, a lifting cylinder 34' is arranged inside the pivot unit 25'. The cylinder end is fixed to the cover 35' of the pivot unit 25' and the rod end is pivotally connected at 36' to the underside of a lifting plate 37'. Arranged on the lifting plate are the support means for the swivelling cylinder 29' and the pivot shaft 28'. The pivot arm 27' and lifting plate 37' can be adjusted by means of the two cylinders to correspond to the position of the winding banks 2', 2'', 3'. Arranged on the underside of the lifting plate are guide rods 38', which are displaceably guided in guide bushes 39' in the cover 35'. The cover 35' is connected fast to the pivot unit 25' so as to turn therewith.

The feeding arrangement 17' assumes a suspended position in relation to the pivot shaft 28'. A supporting arm 40', which extends transversely of the pivot arm 27' and serves to support the supply mechanism 17', is off-set downwardly relative to the pivot arm 27' by means of a connecting rod 41'. The arm 40' projects on both sides of the rod 41'. The longer portion directed towards the textile machine serves for the mounting of an opening device 42', while the oppositely directed shorter portion serves for the mounting of a loading device 43'. Both devices are so constructed that simultaneously two juxtaposed bobbin holders of one bank are fed. The operation as regards the opening and loading of the two adjacent bobbin holders is the same.

The pivot arm 27' and pivot shaft 28' are partly supported by a roller bearing at the bottom end of the vertical connecting rod 41'. When the feeding arrangement pivots, the pair of rollers travel downwards on the cylindrical wall of the pivot unit 25'. The pair of rollers can have associated therewith a stop which, when the arrangement is adjusted vertically, lifts the pair of rollers with the arm 41' away from the cylinder wall. In this way, any scraping of the rollers on the wall is avoided.

The complete opening device 42' is supported on a discharge chute 44' associated therewith, which chute in its turn is held on the support arm 40' to be adjustable longitudinally of the pivot arm 27'. Serving for the adjustable support are two guide rods 45' and 46', which are fixed on a side plate 47' of the chute 44' and engage through guide bushings 48' and 49', which are provided on a side face 50' of the support arm 40'. Arranged on the bottom end of the face 50' is a cylinder 51', which serves for the sideways adjustment of the chute 44'. The purpose of the sideways adjustment is explained below in conjunction with the opening device 42'.

The opening device 42' comprises essentially two pivot arms 52' and 53', which each grip one side of a bobbin lever from below by means of two lateral lugs 54' and 55' and on the other side laterally outwards by means of two abutments 56' and 57' on the free end of the lugs. With another arrangement which is not illustrated, in which the pivot arms grip between the bobbin lever 10' and the bobbins 7', the lugs 56' and 57' can be omitted, because then the pivot arms, preferably constructed as flat metal members, form the stop for gripping the bobbin lever laterally outwards.

The pivot arm 52' is rotatably mounted at 58' on the side plate 47' and the pivot arm 53' is rotatably mounted at 59' on a holding plate 60' of the chute 44'. A cylinder 61', the cylinder end of which is pivoted at 62' on the side plate 47' of the chute 44' while the piston rod end is pivoted at 63' on the pivot arm 52', serves for the upward and downward swivelling of the pivot arm 52', and, through a connecting member 64', the pivot arm 53'.

As already mentioned, the loading device 43' is arranged on that end of the support arm 40' which is furthest from the textile machine, and in fact parallel to the opening device 42'. The loading device comprises two upwardly open grippers 65' and 66', which are interconnected by means of a stirrup member 67' and, by means of a rack 68' which engages on the gripper 65', are jointly adjusted in a horizontal plane transversely of the pivot arm 27' towards the textile machine. The rack 68' is driven by an electric motor 69' through a pinion 70'. The motor 69' is arranged on a lug 71' of the pivot arm 40' which extends parallel to the pivot arm 27'. This lug also comprises two guide bushings 72' and 73', through which extend two guiding and holding rods 74' and 75' of the grippers 65' and 66'. The guide rods are fixed on the gripper 65'.

The grippers 65' and 66' each consist of an immovable part 76', which is adapted to the truncated cone form of the empty tube 26', and a part 77' which is movable relatively thereto and which is made substantially shorter than the part 76' and engages around the middle of the tube 26' like a clamp. The clamping part 77' is capable of swinging away from the part 76' about a shaft 78', against the force of a spring.

The feeding arrangement operates as follows: In the position of the feeding arrangement swung away from the textile machine, which position is not shown, the carriage 16' will travel up to two bobbin holders 6' which are to be fed. The pivot arm 27' will then be swung by means of the pivot cylinder 29' from a position transverse to the longitudinal front of the textile machine 1' into a position parallel thereto. By this means, the opening device 42' is moved into its operating position. The pivot levers 52' and 53' assume their lowest, downwardly swung position. In this position, and with the swinging of the arrangement towards the textile machine, they then also pass beneath the bobbin levers 10', when only an empty tube is disposed in the bobbin holder 6'. By admission of pressure to the cylinder 61', the two bobbin holders in question, by the upward swinging of their bobbin levers 10', are now swung upwards into a prescribed position. Thereafter, by admission of pressure to the cylinder 51', the chute 44' is adjusted in relation to the pivot column 25'. This causes the opening of the two bobbin holders through the stops 56' and 57'. The bobbin 7' rolls down the chute 44'. At this time, another side plate 47a' of the chute ensures that the package discharges in the prescribed manner.

The opening device 42' remains in the position in which it is swung upwardly into the prescribed location and is adjusted laterally. The prescribed height corresponds to the working plane of the loading device 43'. By switching on the electric motor 69', the grippers 65' and 66', each with an empty tube 26', are now moved horizontally by means of the rack 68' and pinion 70' into the region between the centering plates 11' and 12'. As soon as the tubes 26' are positioned between the centering plates, first of all the chute 44' is adjusted away from the pivot column 25'. By this means, the centering plates are caused to engage in the two ends of the tubes. The tubes are now brought to bear against the driving rollers 8' by lowering the levers 52' and 53'. Thus, the new winding operation commences. Before the downward movement of the levers 52' and 53', the grippers 65' and 66' have been returned into the initial position. In this position, the clamps 77' engage under the tubes held by the centering plates, this being against the force of a spring.

For the movement of the arrangement for feeding the next two bobbin holders, the entire feeding arrangement 17' is swung out through 90° away from the textile machine. The grippers 65' and 66' then engage beneath the empty tube magazine 18'. Hence, empty tubes are automatically brought into the grippers in the manner as described, U.S. Pat. No. 3,811,631.

Further details of the structures of the pivoting mechanism, the empty tube grippers, and the empty tube magazine are described in U.S. Pat. No. 3,811,631 and are illustrated in FIGS. 3–6 thereof.

The automatic bobbin changer in technically modified form can be arranged for the rhythmic or random operation of the run-off positions, i.e., for the removal of the empty tubes and for the placement of feed bobbins. Advantageously a suspended movable bobbin transport device according to FIG. 3 is used.

In FIG. 3 there are represented a textile machine 15 with control and drive part 26, run-off bobbins 25 and winding positions 4 as well as a bobbin transport device 12. This bobbin transport device consists again of several members 6a and has partial troughs 22 for the reception of bobbins 3. It is movable in suspension on wheels 10a riding on rails 8a. Expediently the rails have upper rail sections 8a for movement of the bobbin transport device about the room or rooms of the textile plant and lower rail sections 8b in the zone of the textile machine to position the transport device at the level of the winding positions or run-off bobbin positions. the rails 8a can, moreover, extend over all parts of the textile mechanism. For the drive of the bobbin transport device 1 there is a power drive 27, which consists of a directionally reversible electric motor 28, a gear and a battery 29 for current generation. There can also be provided, however, travelling wires for the current supply to the power drive.

In FIG. 5 there is schematically represented a part of a machine room with textile machines 15, run-off bobbin latices 24 set up therebetween, an automatic bobbin changer displaceable between them for removing the finished bobbins, and a transport container 23 movable at the head of the textile machine and driven by means of a battery or other electric drive 30. The transport container 23 serves for the conveyance of the bobbin transport device 1 outside the zone of the machine. The textile machine 34 is one which has just been tended.

The automatic bobbbin changer positioned in front of the machine has already taken off a part of the finished bobbins and deposited them on the bobbin transport device 1. It is also possible, however, to carry out the bobbin changing not in rhythm, but in random alternation. After the tending of machine 34 or one side of this machine, the automatic bobbin changer is driven over rails (not shown) in front of another machine face. The bobbin transport device 1 is now ready for the transportation. It can be moved onward either over the rail system 9 (only partly indicated), by hand, by means of a constantly operating endless chain or by means of a power drive, or otherwise within a transport container like transport container 23. The transport container 23 contains guide rails 31. It is positionable in such a way that the guide rails 31 are aligned parallel to the rails 9. The bobbin transport device 1 can then be introduced member by member into the transport container.

After receiving a transport member, the transport container is moved onward by the spacing of the guide rails 31. Thereupon, the next transport member is thrust in. This process is automated. For this purpose the transport container has end switches 32 in the zone of each guide rail. The end switches are operated by each slide-in transport member. Each end switch is connected in a current circuit in such a way that through its actuation of the drive 30 of the transport container is set in operation. The drive is set out of operation again by means of a step switching mechanism, so that the transport container is moved onward only by a predetermined length.

Figure 7:
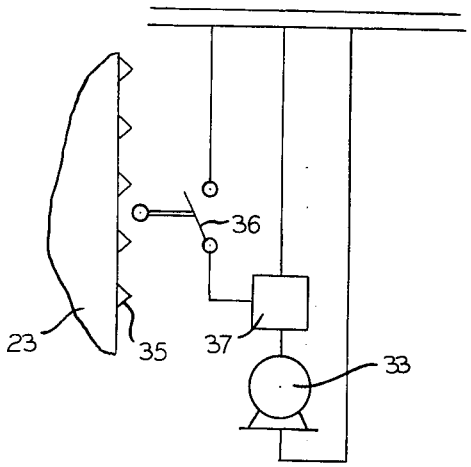
FIG. 7 illustrates diagrammatically a circuit for the automatic movement onward of the bobbin transport device.

The bobbin transport device 1 is moved onward, for example, by a friction wheel drive 33, which is stationarily fixed to the run-off lattice 24. This friction wheel drive is switched on and off by means of end switch 36. For this purpose, the end switch, depending on its construction type, is switched either directly into the circuit of the friction wheel drive 33 or else the end switch is operated—as schematically represented in FIG. 7—by a switching relay 37 interposed in the circuit. The end switch itself is operated by cams 35 (FIGS. 5 and 7) which are arranged on the transport container 23 in a row and spaced at the distance equal to the spacing of the guide rails 31.

Figure 6:
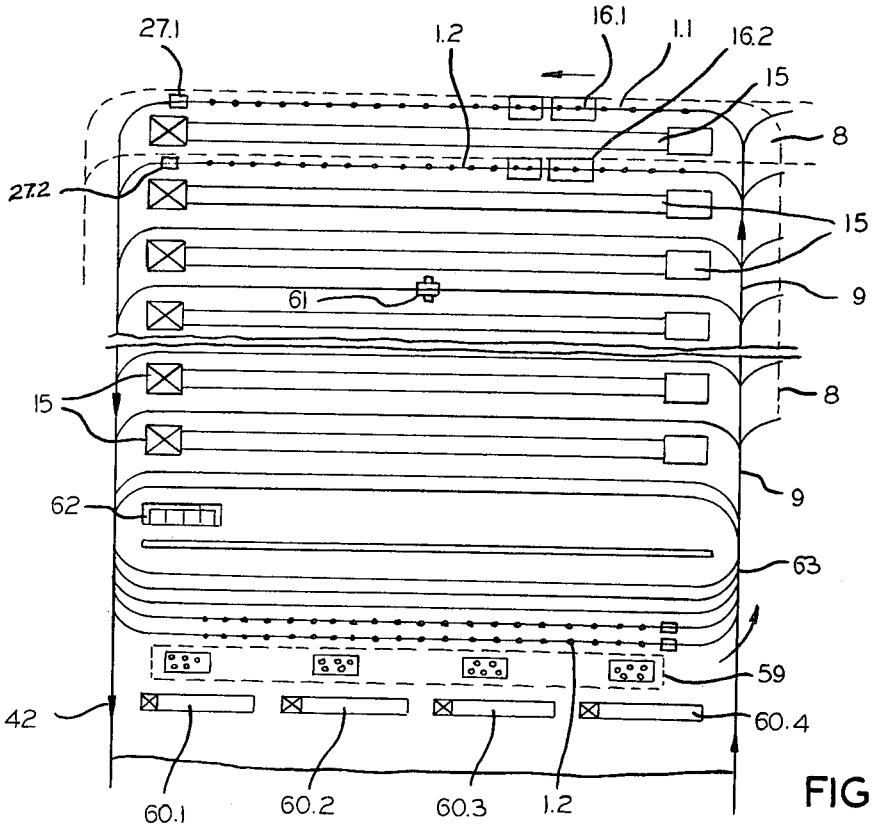

In FIG. 6 there is shown a part of a machine room or textile plant with textile machines 15, an automatic bobbin changer 16.1 displaceable therebetween for equipping the textile machines with new feed bobbins and an automatic bobbin changer 16.2 for removal of the finished bobbins. The automatic bobbin chanagers are displaceable on a floor rail system and are also operable in front of the other textile machines 15.

The feed bobbins are taken from the bobbin transport device 1.2. The finished bobbins are deposited on the bobbin transport device 1.1. These bobbin transport devices are constructed, as shown in FIG. 3, and are displaceable in a suspension rail system 9 by means of power drives 27.1 and 27.2. Over the rail system 9 there is driven, on the one hand, the supply 63, i.e., the product entry, or the goods input control or-as shown in FIG. 6—a sorted interstorage 59 for textile machines 60.1 to 60.4 for the production of the feed bobbins and, on the other hand, the quality control 42 or other processing unit. It serves simultaneously for the transportation of a blowing or suction installation 61, such as are commercially available in many forms and are used for the removal of dust and fibers in textile machines. This arrangement permits a fully automated operation of the entire machine room by remote control 62.

Figure 8:
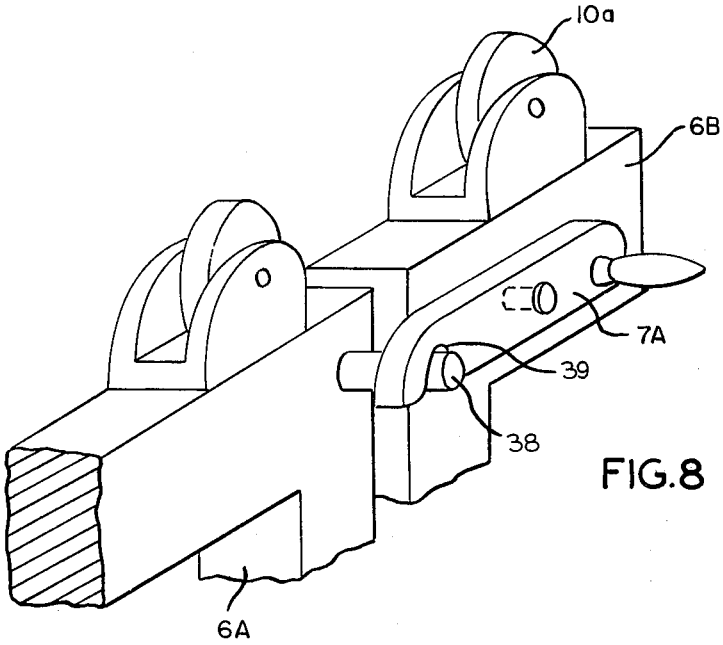
FIGS. 8 and 9 are perspective views of couplings for the bobbin transport device.
Figure 9:
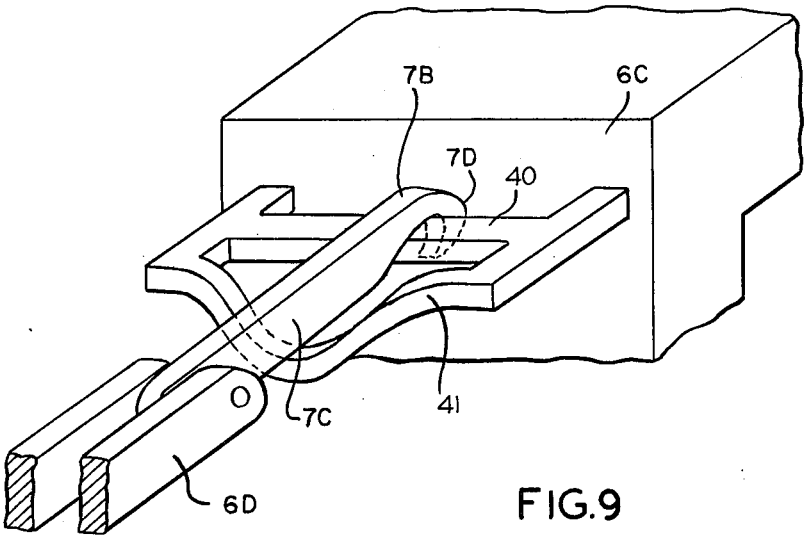

FIG. 8 and FIG. 9 show suitable couplings for connecting the individual members of the bobbin transport device 1. These couplings release automatically in the automatic sliding in of the bobbin transport device or in the advancing of the transport container 23 (FIG. 5). The coupling according to FIG. 8, therefore, can absorb forces exclusively in the longitudinal direction of the bobbin transport device. When the member 6A is moved, in the viewing direction of FIG. 8, to the left or the member 6B is moved to the right, the bolt 38 slides out of the coupling groove 39. The coupling is opened and closed by means of a manual operation. The coupling 7A, according to FIG. 9, snaps in place over a cross piece 40, but lies simultaneously with its flanks on a yoke 41. This yoke has a troughlike depression, through which the coupling hook 7B is lifted and unlatched in a lateral movement of the member 6C or 6D. When the end members 6C or 6D moves laterally relative to the other member the shank 7C of the hook 7B, which normally lies at the bottom of the trough-like depression in the yoke 41, rides up a sloping surface of the trough-like depression, thereby raising the hooked end 7D from its hooking engagement with the cross piece 40. Such lateral movement of the member 6C and/or 6D occurs, for example, when the transport container 23 moves in step-wise fashion (FIGS. 5 and 10).

Figure 10:
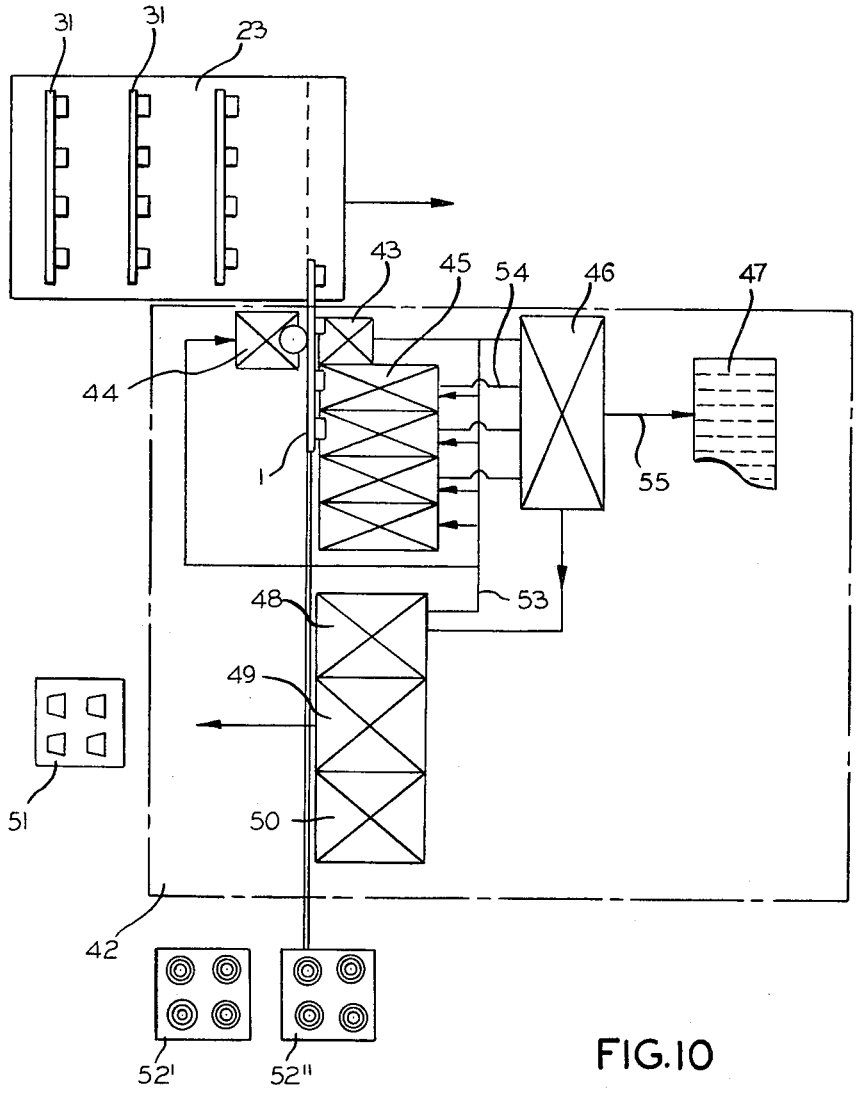
FIG. 10 shows a schematic representation of a quality checking and sorting installation in combination with a bobbin transport device according to the invention.

In FIG. 10 there is a quality testing and sorting device 42. The transport container 23 with the bobbin transport device 1 can be driven up to this quality testing and sorting device. The members projecting from the transport container of the bobbin transport device 1 are conveyed by a friction wheel drive 44. There, a sensing and counting device 43 carries out a number of the individual depositing places according to row and deck and thereby contains, over lines 53, the drive 44. In the transportation onward of the bobbin transport device, the finished bobbins pass into the zone of quality testing devices 45, through which they are guided in the rhythm of the counting device 43. The quality checking devices are, in turn, controlled in the rhythm of the counting devices 43. Thereby all the finished bobbins or finished bobbins selected at random can be subjected to a quality control. Simultaneously, the result of the counting and of the quality check is fed to a printing mechanism 46 and there ejected, for example, in table 47 form. This table is now available for the function monitoring and function improvement of the individual processing places as well as for monitor of the feed material. Moreover, the printer delivers in the rhythm of the counting mechanism 43 its information to a device 48, which serves for the identification of the individual bobbins. Through the device 48, for example, adhesive strips with imprint of the count and of the test result or other markings symbolizing the results of the quality control are applied to the individual finished bobbin. With further movement onward of the bobbin transport device the finished bobbins are conducted into the station 49 and there are removed by hand or automatically from their depositing devices. With the aid of their markings which they have received in station 48, they are sorted by hand or automatically according to quality classes. The packing of the sorted bobbins is done in a further station 50. Additionally there is a crate 51 with waste bobbins sorted and packed bobbins 51' and 52'.

The advantage of the bobbin transport device according to the invention lies in that it permits preparing the equipping of multiplace, multilevel textile machines with feed bobbins of a certain type before the run-off of the old feed bobbins in any desired place of the textile plant in such a way that each feed bobbin is already allocated to a certain working station. It is further designed in an optimum manner for the technical requirements of automatic bobbin changing in multilevel, multiposition textile machines—and insofar as the changing of the finished bobbins is concerned—for the further processing of the removed finished bobbins, especially in the quality control, sorting and packing.

A further advantage lies in that, in contrast to the conveyor belts frequently used, a bobbin transport device according to the invention can be used for the serving of a plurality of textile machines.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

To summarize, the invention provides a combination of a textile machine having bobbin winding stations positioned along a face therein in multi-level rows and spatially arranged in a apredetermined geometric pattern, and a bobbin transport unit movable along said face for transportation from the winding stations of finished bobbins. The transport unit is characterized by a plurality of bobbin-receiving means for receiving respective finished bobbins discharged from said stations and spatially arranged in the same geometric pattern as said first-mentioned pattern, e.g., in a vertical lattice.

Preferably, the transport unit extends substantially the full length of the face of the textile machine. Its bobbin-receiving means may be trough members or projecting hooks. Alternatively, the transport unit may comprise a row of a series of vertically suspended rods with means on the free ends of said rods to receive finished bobbins placed thereon. The rods have different lengths to spatially position their free ends in accordance with said geometric pattern.

Movement of the transport unit preferably embodies rail means supporting said transport unit for movement along the machine face with locomotive means coupled to the transport unit for moving it along the rail means. The rail means may further have suspended thereon blowing and suction means for removal of textile fines.

Preferably, the transport unit comprises a longitudinal series of individual sections having coupling means releasably connecting respective sections together. The combination preferably also includes a transport container movable perpendicular to the longitudinal axis of the textile machine across the front thereof with a plurality of means in said container for respectively receiving individual sections of said transport unit. The coupling means in such case preferably embodies means releasable by lateral movement of one of said sections relative to the next section and is capable of absorbing only forces vectored substantially in the longitudinal direction of said unit.

The sectional transport unit-transpsort container combination drive provides means for moving said transport container stepwise across the front of said machine. A plurality of switch means are operatively connected to said drive means and are positioned in said transport container for operation of respective switch means upon movement of a respective section into said transport container. The combination may utilize drive means, adjacent the textile machine, for moving said transport unit, e.g., a friction drive wheel acting on said transport unit. To further enhance the proper, automated functioning of the combination, there is provided switch means activated by contact means on the transport container to activate the transport units' drive means when the transport container is at rest and to deactivate said drive means when said transport container is in motion.

The combination may further include bobbin changing means positioned between the face of the textile machine and the transport unit. The bobbin changing means is mounted for movement along the machine face, e.g., on rails. The bobbin changer means preferably has a plurality of bobbin-conveying chutes for guiding discharged, finished bobbins from their respective winding stations to the respective bobbin-receiving means of said transport unit, the chutes being arranged in a plurality of decks in the aforesaid geometric spatial pattern. The combination may further include means for conveying the transport unit with finished bobbins therein into means for performing one or more of sorting, testing and marking of the finished bobbins.

The invention is hereby claimed as follows:

1. The combination of a textile machine having bobbin winding stations positioned along a face therein in multi-level rows and spatially arranged in a predetermined geometric pattern, and a bobbin transport unit movable along said face for transportation from the winding stations of finished bobbins, said transport unit being characterized by a plurality of bobbin-receiving means for receiving respective finished bobbins discharged from said stations and spatially arranged in the same geometric pattern as said first-mentioned pattern, means for exchanging an empty bobbin for finished bobbin, and transfer means for transferring the individual finished bobbins to respective bobbin receiving means of said transport unit.

2. The combination as claimed in claim 1, said transfer means having a plurality of bobbin-conveying chutes for guiding discharged, finished bobbins from their respective winding stations to the respective bobbin-receiving means of said transport unit.

3. The combination as claimed in claim 2, said chutes being arranged in a plurality of decks.

4. The combination as claimed in claim 1, and means mounting said transfer means for movement along said face of said machine between said face and said transport unit.

5. The combination as claimed in claim 2, and means mounting said chutes for movement along said face of said machine between said face and said transport unit.

6. The combination as claimed in claim 1, said transport unit being further characterized by a longitudinal series of a plurality of longitudinally movable, longitudinally aligned, bobbin-receiving sections, each section being shorter in length than the length of said face, each section having a plurality of said bobbin receiving means.

7. The combination as claimed in claim 6, coupling means releasably coupling said sections together, and a transport container movable perpendicular to the longitudinal axis of the machine across the front thereof, and a plurality of means in said container for respectively receiving individual sections of said transport unit.

8. The combination as claimed in claim 7, drive means for moving said transport unit longitudinally, and switch means acitvated by means on said transport container to activate said drive means when said transport container is at rest and to deactivate said drive means when said transport container is in motion.

9. The combination of a textile machine having bobbin winding statons positioned along a face therein in multi-level rows and spatially arranged in a predetermined geometric pattern, and a bobbin transport unit movable along said face for transportation from the winding stations of finished bobbins, said transport unit being characterized by a plurality of bobbin-receiving means for receiving respective finished bobbins discharged from said stations and spatially arranged in the same geometric pattern as said first-mentioned pattern, means for doffing the individual finished bobbins, and transfer means for transferring the individual doffed bobbins to respective bobbin-receiving means of said transport unit.

10. The combination as claimed in claim 9, said transfer means having a plurality of bobbin-conveying chutes for guiding discharged, finished bobbins from their respective winding stations to the respective bobbin-receiving means of said transport unit.

11. The combination as claimed in claim 10, and means mounting said chutes for movement along said face of said machine between said face and said transport unit.

12. The combination as claimed in claim 9, and means mounting said transfer means for movement along said face of said machine between said face and said transport unit.

13. The combination as claimed in claim 9, said transport unit being further characterized by a longitudinal series of a plurality of longitudinally movable, longitudinally aligned, bobbin-receiving sections, each section being shorter in length than the length of said face, each section having a plurality of said bobbin recieving means.

14. The combination as claimed in claim 13, coupling means releasably coupling said sections together, and a transport container movable perpendicular to the longitudinal axis of the machine across the front thereof, and a plurality of means in said container for respectively receiving individual sections of said transport unit.

* * * * *